United States Patent [19]

Hasegawa et al.

[11] 4,422,670

[45] Dec. 27, 1983

[54] COLOR DEVELOPING SHEET FOR PRESSURE-SENSITIVE RECORDING SHEET

[75] Inventors: Akira Hasegawa; Ippei Shimizu, both of Tokyo; Kaneko Toshio; Sumio Miyake, both of Iwaki, all of Japan

[73] Assignee: Jujo Paper Co., Ltd., Tokyo, Japan

[21] Appl. No.: 343,840

[22] Filed: Jan. 29, 1982

[30] Foreign Application Priority Data

Feb. 12, 1981 [JP] Japan ..... 56-18102

[51] Int. Cl.[3] ..... B41M 5/16; B41M 5/22

[52] U.S. Cl. ..... 282/27.5; 428/327; 428/328; 428/329; 428/330; 428/331; 428/341; 428/342

[58] Field of Search ..... 427/150, 151; 428/320.2, 320.4, 320.6, 320.8, 913, 914, 323, 327–331, 341, 342, 537, 488; 282/27.5

[56] References Cited

U.S. PATENT DOCUMENTS

| | | | |
|---|---|---|---|
| 3,540,910 | 11/1970 | Lin | 427/261 |
| 3,767,449 | 10/1973 | Hayashi | 428/328 |
| 4,076,887 | 2/1978 | Tsuji et al. | 428/411 |
| 4,234,212 | 11/1980 | Kato et al. | 428/913 |

*Primary Examiner*—Bruce H. Hess

*Attorney, Agent, or Firm*—Koda and Androlia

[57] ABSTRACT

A color developing sheet for pressure-sensitive recording sheet containing in its color developing layer, an organic coreactant (color developing agent), calcium carbonate and styrene-butadiene copolymer latex or modified styrene-butadiene copolymer latex of an average particle size of less than 0.08$\mu$ whereby a color developing sheet having excellent water resistance, very improved mark formation, improved printability, high surface strength, rapid setting of ink, etc. is provided.

14 Claims, No Drawings

COLOR DEVELOPING SHEET FOR PRESSURE-SENSITIVE RECORDING SHEET

BACKGROUND OF THE INVENTION

1. Field of the Invention

The present invention relates to a pressure-sensitive recording paper, and more particularly, to an improvement in the mark formation and printability of the pressure-sensitive recording paper.

2. Prior Art

Generally, pressure-sensitive recording paper consists of a top sheet (CB) of which the back side is coated with microcapsules containing colorless or pale colored electron donative leuco dyes dissolved in an organic solvent (capsule oil) and a bottom sheet (CF) which has a color developing layer containing electron acceptive color developing agent on its front side.

When the top sheet is laid on the bottom sheet and local pressure is applied to them by handwriting with a ball-point pen or the like, the capsules to which pressure is applied are ruptured and the oil in the capsules containing leuco dyes is transferred to the color developing layer; and a printed mark is formed by color generating reaction of the leuco dyes and electron acceptive color developing agent.

The color developing sheet mentioned in this invention is a sheet which has the above color developing layer, including a middle paper (CFB) which is coated with a electron acceptive color developing agent on the front side and capsules on the back side in addition to a bottom sheet (CF) described above.

In recent years, the demand for pressure-sensitive recording paper has increased very rapidly with the systemization of offices, expansion of the information industry and the spread of computers.

As a result, the applications for paper have been diversified and many properties are needed with regard to the diversified applications for paper.

Not only is it required that the paper record images but improvement of the ink setting of the color developing sheets on which the mark forms is also required in order to adapt to high speed printing of normal ink for characters or lines and desensitizing ink.

It is necessary for the color developing layer to absorb and set the normal inks or the desensitizing ink in a very short time in order to adapt to high speed printing.

Also, stickiness of the printed surface or setting off of printed ink to another paper surface can be prevented by improvements of the ink setting speed of the color developing sheets; as a result, high speed printing becomes possible.

Especially, in the case of desensitizing printing, it is required to apply a larger amount of ink than for normal ink printing. Therefore, not only is it required to increase the ink absorbing speed of the color developing layer but also it is required to increase the ink absorbing amount in order to accelerate the ink setting.

Usually, the coating color of the color developing sheet contains electron acceptive coreactant with inorganic pigments such as kaoline, talc and calcium carbonate or organic pigments such as urea-formaldehyde resins as fillers.

Moreover, latexes and one or more sorts of natural or synthetic aqueous polymers are added in order to fix the above-mentioned materials on the sheet.

Furthermore, if desired, viscosity adjusting agents and pH adjusting agents and so on can be added.

The above-described coating color is coated on the base paper by a coater and dried.

For the purposes of advancing the color developing ability and improving the ink absorption, many methods for transferring capsule oil efficiently to the color developing sheet have been studied such as by adding some amount of fillers which absorb the oil very much to the color developing layer. With regard to these fillers, they are disadvantages in that the adhesion of the fillers to the sheet decreases as the amount of fillers increases. Therefore, filler is picked off from the paper surface during printing and the filler adheres to the rubber blankets and scum the printing plate. As a result, practical products cannot be obtained.

One method is to use relatively fine calcium carbonate of which 55 percent of the particle size distribution is less than $2\mu$. This method is described in Japanese Laid Open Patent Application No. 28857/1980. However, these finer fillers have higher specific surface; therefore, the obtained strength will be insufficient if the usual amount of binder is used and it becomes impossible to fix the fillers and other materials to the sheet sufficiently. As a result, the coating products are easily picked off and the surface strength of the sheet is insufficient for commercial printing.

Also, as the surface strength becomes high, the mark formability becomes low. If a larger amount of binder is added as a countermeasure, the desired result cannot be obtained. On the other hand, since latexes when used as a binder, in comparason with water soluble polymers as a binder, give a coating color with high concentration and low viscosity, they have advantages that decreased drier load can be obtained and various coaters can be used and hence high-speed coating etc. is possible. Furthermore, the resultant color developing sheet has excellent water-resistance.

SUMMARY OF THE INVENTION

Accordingly, it is a general object of the present invention to provide a color developing sheet which has both improved mark formation and improved printability with high surface strength, rapid setting of the printing ink, etc.

The above-mentioned and other related objects can be accomplished by using styrene-butadiene copolynmer latex (put on the market, the ratio of styrene to butadiene ranges from 40:60 to 70:30) or carboxylated styrene-butadiene copolymer latex (put on the market, the carboxylated degree ranges from 10 to 20%) of an average particle size of lss than $0.08\mu$ as a binder in the color developing layer containing the organic coreactant (color developing agent) and calcium carbonate.

DETAILED DESCRIPTION OF THE INVENTION

Electron acceptive color developing agents (herein after referred to as coreactants), which are used in the color developing sheet, are inorganic solid acids such as acid clay, attapulgite described in U.S. Pat. No. 2,712,507, p-substituted phenol-formaldehyde polymer described in Japanese Patent Publication 20144/1967, aromatic carbonic acids or their metal salts described in Japanese Patent Publication No. 1086/1974 and No. 1327/1977, and metal salts of 2, 2 bisphenol sulfonates described in Japanese Laid Open Patent No.

106313/1979. In this invention organic coreactants among the above-mentioned coreactants are utilized.

Furthermore, it has been found that water resistance, mark forming ability, printability and other properties of the color developing sheet are remarkably improved when calcium carbonate as a filler and styrene butadiene copolymer latex or carboxylated styrene butadiene copolymer latex (hereinafter referred to as SBR-latex or carboxylated SBR-latex) of average particle size of less than 0.08μ as a binder are used together in the coating color which contains the organic coreactants.

The organic coreactants in accordance with the present invention include phenolic substance such as p-tertiary buthylphenol-formaldehyde condensate, p-phenylphenol-formaldehyde condensate, p-octylphenol-formaldehyde condensate zinc-modified p-octylphenol-formaldehyde condesnate, etc., and orgainc acid-substances such as metal salt of 2, 2-bisphenol sulfone, metal salt of ditertiary buthyl salicyclic acid, etc. If desired, these organic coreactants may be used singly or in combination with the other coreactants.

Generally, it is suitable to add 5 to 15 percent by weight of the organic coreactant per total solids content of the coating color of the color developing layer.

The reasons why the color developing sheet made from the combination of the above-mentioned materials is remarkably improved are not clear. However, the inventors observed that many gaps are made among the piled layers of calcium carbonate particles in an electron-microscopic photograph of its surface. It seems that capsule oil in which leuco dyes are contained transfers efficiently from the top layer (CB) to the color developing layer as a result of capillary action of these gaps. In this case, SBR-latex or carboxylated SBR-latex of fine particle size does not damage the above-mentioned gaps but fixes the calcium carbonate particles effectively in comparison with other latexes. Therefore, excellent mark forming ability is obtained with high surface strength. This property of SBR-latex or modified SBR-latex of an average particle size of less than 0.08μ has a dramatic effect in the combination with fine calcium carbonate particles. The fine and numerous gaps, which are made by piling up very fine particles of calcium carbonate, transfer capsule oil effectively and improve the mark forming ability remarkably. The SBR-latex or carboxylated SBR-latex of fine particles does not damage these gaps and good mark forming ability can be obtained.

The feature of this invention is that a color developing sheet with excellent quality can be produced by combining calcium carbonate with a suitable binder.

The styrene-butadiene latex or the carboxylated styrene-butadiene latex of the present invention is very fine with an average particle size of less than 0.08μ, and differs from the usual styrene-butadiene latexes which have an average particle size of more than 0.15. The effect of the present invention cannot be obtained by using the usual styrene-butadiene latexes. Furthermore, the color developing sheet contained styrene-butadiene latex of the present invention is superior in water resistance to color developing sheets containing water soluble polymers as a binder such as polyvinylalcohol, carboxymethyl cellulose, hydroxyethyl cellulose, oxidized starch, etc. Hence, the addition of aldehydes such as formaldehyde, glyoxal and glutaraldehyde as a water resistance agent is not required.

The amount of SBR-latex or carboxylated SBR-latex in the present invention is determined depending upon the performance, etc. required for the pressure sensitive paper and is not otherwise limited. However, in the ordinary case it is suitable to add 5 to 25 percent by weight of SBR-latex or modified SBR-latex per total solids content of the coated color of the color developing layer. It is possible to use other binders with the SBR-latex or carboxylated SBR-latex if the coated methods are selected suitably. In particular the viscosity or water-retention properties of the coating color can be improved without decreasing the color developing ability by the usage of oxidized starch, other modified starch, casein, gelatine, methyl cellulose, ethyl cellulose, hydroxyethyl cellulose, hydroxypropyl cellulose, carboxymethyl cellulose, carboxyethyl cellulose, sodium polyacrylate, polyvinylacetate latex and derivative or (e.g. acrylamide modified polyvinylalcohol).

While the usual calcium carbonate of an average particle size of less than 3μ can be used in the present invention, calcium carbonate of smaller particle size can be used in combination with the SBR-latex or carboxylated SBR-latex of the present invention and the resultant effect obtained is very remarkable. Therefore, it is desirable to use calcium carbonate having an average particle size of less than 0.6μ and preferably less than 0.4μ. Furthermore, in this invention both ground and precipitated calcium carbonate can be used; however, precipitated calcium carbonate is more suitable because the distribution of the particle size is sharper. The particle mentioned in this invention means ground single particles in the case of ground calcium carbonate; and in the case of precipitated calcium carbonate, it means single particles or aggregated particles constituted from a few to several tens, which change according to the conditions of the producing reaction. Though the size of the aggregated particles of the precipitated calcium carbonate is not specifically limited, usually it is desirable to be less than 5μ at the most.

The formulation ratio of calcium carbonate is desirable to be 5 to 20 times as much as the coreactants by solid weight and more than 30 percent by total solid weight of the color developing layer. Also, if desired, it is effective to use together with the calcium carbonate, other pigments such as kaoline, talc, aluminium oxide, aluminium hydroxide, zinc oxide, zinc hydroxide, or magnesium carbonate and the like as supplementary filler. Also fine and relatively large particles of calcium carbonate can be used together without trouble. The color developer coating color, prepared by the above-mentioned method, is coated with 5 to 6 g/m$^2$ by solid weight on the base sheet and dried. The obtained color developing sheet has excellent water resistance, high brightness, and the colored mark developes rapidly. Also the terminal color density is very high and a clear mark is formed when the piled set of top sheet (CB) and this sheet is typewritten. Scrumming of the rubber blanket and plate of the printing press does not take place when the above-described color developing sheet is printed by using the desensitizing ink after preprinting characters and lines by offset printing. Moreover, offset of preprinted normal ink and desensitizing ink does not take place because the setting of the ink is very rapid and the printability of the sheet is excellent.

In the following is an explanation of the present invention shown by examples.

EXAMPLE 1

An inorganic pigment slurry was prepared by diluting precipitated calcium carbonate (MP555S manufactured by Maruo Calcium Co.) of an average particle size of 0.33μ to 33 percent by weight with water. 50 parts by weight of p-phenylphenol resin emulsion of which the solid was 40 percent were added to 300 parts by weight of inorganic pigment slurry under stirring by a Labomixer. The 17.4 parts by weight of SBR-latex with an average particle size of 0.03μ and with 46 percent by weight solid content added thereto. The resultant color coating was coated on 40 g/m² base paper with 5 to 6 g/m² coating by a mayer bar.

After drying, a color developing sheet No. 1 was obtained. Furthermore, color developing sheets Nos. 2, 3, 4 and 5 were obtained using SBR-latexes with average particle sizes of 0.05μ, 0.08μ, 0.10μ and 0.15μ, respectively, in the same parts by weight of solid contents instead of using the SBR-latex of an average particles size of 0.03μ.

These color developing sheets were tested as follows:

1. Color Intensity

A color sheet (NR/40T manufactured by Jujo Paper Co., Ltd.) was laid upon the color developing sheet and this pile was typewritten on utilizing an electric typewriter at a constant impact pressure. Color intensity of the formed mark was measured at one hour after the typewriting.

Brightness of the color developing sheet was measured by a Hunter Reflectometer before and after mark formation by the typewriting and color intensity was calculated in accordance with the following equation.

Brightness before mark formation (%)=$I_o$

Brightness at oe hour after mark formation by typewriting (%)=$I_t$

Color intensity (%)=$D_t$ $$D_t = \left(\frac{I_o - I_t}{I_t}\right) 100$$

2. Surface Strength

Picking off of the coated material was organol-eptically evaluated after printing three times on the coated surface of the color developing sheet with offset printing ink whose tack value was 10 (manufactured by Toyo Ink Mfg. Co.) by using a RI printability tester (made by Akira works).

3. Absorptivity of K&N Ink

K&N (manufactured by K&N Laboratory Inc. in the U.S.A.) was spread uniformly on the coated surface of the color developing sheet and then the ink was wiped off with a cloth after two minutes and the absorption of ink was measured.

The absorptivity of the K&N ink was calculated in accordance with the following equations after measuring the brightness of the sheets before and after ink application.

Brightness before ink application (%)=$I_o$

Brightness after ink application (%)=$I_k$

K&N ink absorptivity (%)=$D_k$ $$D_k = \left(\frac{I_o - I_k}{I_o}\right) 100$$

Test results of Example 1 are shown in Table 1.

All color developing sheets had high color intensity of the formed mark. However, in accordance with increased average particle size of the SBR-latex, K&N ink absorptivity increased and the surface strength decreased. The color developing sheets of the reference examples Nos. 4 and 5 which used SBR-latexes with average particle sizes of 0.10μ and 0.15μ respectively resulted in that the fillers were picked off and could not be used practically.

TABLE 1

The Quality Tests of Example 1

| Color developing sheet | Color intensity by typewriting | K & N ink absorptivity | Surface Strength | Note |
|---|---|---|---|---|
| No. 1 | 44 | 36 | good | Present invention |
| No. 2 | 45 | 37 | good | Present invention |
| No. 3 | 45 | 38 | fair | Present invention |
| No. 4 | 46 | 38 | inferior | Reference Example |
| No. 5 | 46 | 38 | inferior | Reference Example |

EXAMPLE 2

Various slurries of inorganic pigments as shown in Table 2 were prepared. 50 parts by weight of p-phenylphenol resin emulsion of 40 percent solid content were added to 300 parts by weight of the inorganic pigment slurries while being stirred by Labomixer. 15.2 parts by weight of SBR-latex (46 percent by weight solid content) of an average particle size of less than 0.05μ and 25 parts by weight of an aqueous oxidized starch solution (20 percent by weight solid content; Oji Ace B manufactured by Oji) were added thereto.

The seven obtained coating colors were coated on 40 g/m² base paper with 5 to 6 g/m² coating amount by a mayer bar. After drying, color developing sheets Nos. 6 through 12 were obtained.

TABLE 2

| Color developing Sheet | Used Filler |
|---|---|
| No. 6 | 60% slurry of precipitated calcium carbonate (TP222HS manufactured by Okutama Kogyo Co.) of which average particle size becomes 2μ by aggregation of single particles with 0.2μ size was diluted to 33% with water. |
| No. 7 | 65% slurry of precipitated calcium carbonate of which average particle size was 0.33μ (MP555S manufactured by Maruo Calcium Co.) was diluted to 33% with water |
| No. 8 | 70% slurry of ground calcium carbonate of which average particle size was 0.55μ, (FC-40 manufactured by Maruo Calcium Co.) was diluted to 33% with water. |
| No. 9 | 100 parts by weight of the ground calcium carbonate powder of which average particle size was 1.8μ (Whiton SSB Red manufactured by Shiraishi Kogyo Co.) 0.4 parts of sodium polyacrylate, and 100 parts of water was mixed and dispersed about 15 minutes by Labomixer. The dispersed slurry was diluted to 33% with water |
| No. 10 | 100 parts by weight of the precipitated calcium carbonate powder of which average particle size was 2μ (PC, manufactured by Shiraishi Kogyo Co.) 0.5 parts of sodium hexameta phosphate and 100 parts of water was mixed and dispersed about 15 minutes by Labomixer. The dispersed slurry was diluted to 33% with water |
| No. 11 | 100 parts by weight of kaoline clay powder of which average particle size was 2μ (Kaobrite, |

TABLE 2-continued

| Color developing Sheet | Used Filler |
|---|---|
| | manufactured by Thiele Co. in the U.S.A.) 0.6 parts of sodium hexameta phosphate and 100 parts of water was mixed and dispersed about 15 minutes by Labomixer. The dispersed slurry was diluted to 33% with water. |
| No. 12 | The slurry of No. 11 was ground one hour in attritor and its average particle was size was 0.5μ |

The test result of the above-mentioned color developing sheets are shown in Table 3.

TABLE 3

| Color developing sheet | Quality Test of Example 2 | | | |
|---|---|---|---|---|
| | Color intensity by typewriting | K & N ink absorptivity | Surface Strength | Note |
| No. 6 | 46 | 38 | good | Present invention |
| No. 7 | 45 | 37 | good | Present invention |
| No. 8 | 45 | 37 | good | Present invention |
| No. 9 | 44 | 36 | good | Present invention |
| No. 10 | 44 | 36 | good | Present invention |
| No. 11 | 39 | 29 | good | Reference example |
| No. 12 | 39 | 30 | good | Reference example |

As obviously seen from Table 3, color developing sheets Nos. 6 through 10 of the present invention using the combination of calcium carbonate and fine SBR-latex provided excellent color intensity (by typewriting) and high ink absorptivity as compared with Reference examples Nos. 11 and 12 using the combination of kaolin and the above SBR-latex. Particularly, the color developing sheets Nos. 6 through 8 using SBR-latex of fine particles had very excellent results.

REFERENCE EXAMPLE 1

Coating colors were prepared by the same method as Example 2 except by using 10 parts by weight of SBR-latex (Dow 620, manufactured by Asahi-Dow Co., Ltd.) of 0.15μ average particle size instead of using 7 parts by weight of fine SBR-latex of 0.05μ average particle size.

The color developing sheets Nos. 13 through 19 were obtained as shown in Table 4.

TABLE 4

| Color Developing sheets | Color Developing Sheets of Reference Example 2 |
|---|---|
| | Used Filler |
| No. 13 | TP222HS same as No. 6 |
| No. 14 | MP555S same as No. 7 |
| No. 15 | FC-40 same as No. 8 |
| No. 16 | Whiton SSB Red same as No. 9 |
| No. 17 | PC same as No. 10 |
| No. 18 | Kaobrite same as No. 11 |
| No. 19 | Kaobrite ground by Attritor same as No. 12 |

Test results of the above-mentioned color developing sheets tested in the same way as Example 1 are shown in Table 5. The Reference examples provided inferior surface strength in spite of using increased binders when compared with Example 2 of the present invention. Also the fillers of the color developing sheets Nos. 13 through 15 (by using fine calcium carbonate) were picked off remarkably. Reference example Nos. 16 through 19 which had some surface strength were insufficient in color intensity (by typewriting) and K & N ink absorptivity. In this case, the increased addition of binder for improved surface strength gives further decreased color intensity by typewriting. In the Reference example Nos. 16 through 19, decreased addition of binder for increased color intensity by typewriting gives insufficient surface strength. Thus, it is obvious that the color developing sheets of the present invention using fine SBR-latex in Example 2 provided sufficient surface strength, with a small amount of binder which leads to very excellent color intensity and K & N ink absorptivity.

TABLE 5

| Color developing sheet | Quality Test of Reference Example 1 | | | |
|---|---|---|---|---|
| | Color intensity by typewriting | K & N ink absorptivity | Surface Strength | Note |
| No. 13 | 41 | 32 | inferior | Reference example |
| No. 14 | 41 | 32 | inferior | Reference example |
| No. 15 | 40 | 32 | inferior | Reference example |
| No. 16 | 38 | 30 | good | Reference example |
| No. 17 | 39 | 30 | good | Reference example |
| No. 18 | 39 | 30 | good | Reference example |
| No. 19 | 38 | 30 | good | Reference example |

EXAMPLE 3

Five kinds of color developing coating colors having a solid-content proportion as follows were prepared using precipitated calcium carbonate of 0.33μ average particle size and kaolin of 2μ average particle size as inorganic pigments in the various proportions as shown in Table 6.

TABLE 6

| Samples | Solid Contents (weight-%) |
|---|---|
| inorganic pigment (precipitated calcium carbonate and kaolin) | 100 parts (76.3) |
| 3.5-ditertiary butyl salicylate zinc salt | 20 parts (15.3) |
| SBR-latex of 0.05μ average particle size | 6 parts (4.6) |
| oxidized starch | 5 parts (3.8) |

The coating colors were applied on 40 g/m$^2$ paper at a coating weight of 5 to 6 g/m$^2$ by a mayer bar. After drying the color developing sheets Nos. 20 through 24 were obtained. These color developing sheets were tested by the same methods as in Example 1 and the test results are shown in Table 7.

TABLE 6

| Color developing sheet | Color Developing Sheets of Example 3 | |
|---|---|---|
| | Used Pigment | |
| | precipitated calcium carbonate of 0.33μ average particle size. | kaolin |
| No. 20 | 85 parts | 15 parts |
| No. 21 | 70 parts | 30 parts |
| No. 22 | 55 parts | 45 parts |

TABLE 6-continued

| Color developing sheet | Color Developing Sheets of Example 3 — Used Pigment: precipitated calcium carbonate of 0.33μ average particle size. | kaolin |
|---|---|---|
| No. 23 | 40 parts | 60 parts |
| No. 24 | 25 parts | 75 parts |

The color developing sheets of Example 3 provided sufficient surface strength, excellent color intensity by typewriting and good K & N ink absorptivity, although they used a smaller amount of binder than the color developing sheets of Example 2 and Reference example 1.

Although the K & N ink absorptivity is practically desirable to be 33 or more, the color developing sheets No. 24 in which precipitated calcium carbonate was used in an amount of less than 33 percent by weight per total solid content of the color developing coating color provided K & N ink absorptivity of 33 which is the minimum value of the usable range. On the other hand, the color developing sheets Nos. 20 through 23, in which more than 30 percent by weight of calcium carbonate was used per total solid contents, provided a sufficient K & N ink absorptivity and superior results in other qualities.

TABLE 7

| Color developing sheet | Quality Test of Example 3: Color intensity by typewriting | K & N ink absorptivity | Surface Strength | Note |
|---|---|---|---|---|
| No. 20 | 46 | 38 | good | Present invention |
| No. 21 | 45 | 37 | good | Present invention |
| No. 22 | 44 | 36 | good | Present invention |
| No. 23 | 43 | 35 | good | Present invention |
| No. 24 | 41 | 33 | good | Reference invention |

It should be apparent to those skilled in the art that the above-described embodiments are merely illustrative of but a few of the many possible specific embodiments of the present invention. Numerous and various other arrangements may be apparent to those skilled in the art without departing from the spirit and scope of the invention.

We claim:

1. Color developing sheet for a pressure sensitive recording sheet having a color developing layer comprising an organic electron acceptive color developing agent, calcium carbonate and styrene-butadiene copolymer latex or carboxylated styrene-butadiene copolymer latex of an average particle size of less than 0.08μ and wherein the ratio of styrene to butadiene in the styrene-butadiene copolymer latex is from 40:60 to 70:30, said calcium carbonate being used in an amount of more than 30% by weight per total solid content of said color developing agent.

2. Color developing sheet according to claim 1, wherein said calcium carbonate has an average single particle size of less than 0.6μ.

3. Color developing sheet according to claim 1, wherein said calcium carbonate has an average single particle size of less than 0.4μ.

4. Color developing sheet according to claim 1, wherein said calcium carbonate is used in an amount of at least 30 percent by weight per total solid content of the color developing layer.

5. Color developing sheet according to claim 1, wherein the amount of said calcium carbonate is 5 to 20 times as much as said organic electron acceptive color developing agent by solid weight.

6. Color developing sheet according to claim 1, wherein said color developing layer further comprises other pigment, in addition to said calcium carbonate.

7. Color developing sheet according to claim 6, wherein said other pigment is at least one member selected from the group consisting of kaolin, talc, aluminium oxide, aluminium hydroxide, zinc oxide, zinc hydroxide and magnesium carbonate.

8. Color developing sheet according to claim 1, wherein fine and relatively large particles of said calcium carbonate are contained in said color developing layer.

9. Color developing sheet according to claim 1, wherein said styrene-butadiene copolymer latex or carboxylated styrene-butadiene copolymer latex is used in an amount of 5 to 25 percent by weight per total solid content of said color developing layer.

10. Color developing sheet according to claim 1, wherein said color developing layer further comprises another binder, in addition to said styrene-butadiene copolymer latex or said carboxylated styrene-butadiene copolymer latex.

11. Color developing sheet according to claim 10, wherein said another binder is at least one member selected from a group consisting of oxidized starch, dialdehyde starch, hydroxymethyl starch, hydroxyethyl starch, carboxymethyl starch, casein, gelatin, methylcellulose, ethylcellulose, hydroxyethylcellulose, hydroxypropylcellulose, carboxymethylcellulose, carboxyethylcellulose, sodium polyacrylate and polyvinylacetate latex.

12. Color developing sheet according to claim 1, wherein said organic electron acceptive color developing agent is at least one member selected from a group consisting of phenolic substance and organic acid substance.

13. Color developing sheet according to claim 1, wherein said color developing sheet comprises another electron acceptive color developing agent in addition to said organic electron acceptive color developing agent.

14. Color developing sheet according to claim 1, wherein said color developing layer is applied with 5 to 6 g/m$^2$ by solid weight on a base sheet.

* * * * *